US009416466B1

(12) United States Patent
Weiner

(10) Patent No.: US 9,416,466 B1
(45) Date of Patent: Aug. 16, 2016

(54) CORE CABLING

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 185 days.

(21) Appl. No.: 14/160,123

(22) Filed: Jan. 21, 2014

Related U.S. Application Data

(60) Provisional application No. 61/791,241, filed on Mar. 15, 2013.

(51) Int. Cl.
*D02H 1/00* (2006.01)

(52) U.S. Cl.
CPC ..... *D02H 1/00* (2013.01)

(58) Field of Classification Search
CPC ..... D01H 1/183; D01H 7/86; D01H 7/862; D01H 7/868; D02H 1/00
USPC ..... 57/10, 12, 14, 17, 18
See application file for complete search history.

(56) References Cited

U.S. PATENT DOCUMENTS

| | | | | | |
|---|---|---|---|---|---|
| 3,146,573 | A * | 9/1964 | Jones | D01H 1/18 | 242/131.1 |
| 3,237,391 | A * | 3/1966 | Carruthers | D01H 1/18 | 57/18 |
| 3,935,698 | A * | 2/1976 | Lesnik | B65H 49/06 | 57/18 |
| 4,389,837 | A * | 6/1983 | Stahlecker | D02G 3/385 | 57/16 |
| 4,998,403 | A * | 3/1991 | Bailey | D02G 3/328 | 242/118.3 |
| 5,613,643 | A * | 3/1997 | Weiner | B65H 57/12 | 112/163 |
| 5,901,544 | A * | 5/1999 | McNeill | D02G 3/343 | 28/252 |
| 6,101,801 | A * | 8/2000 | Boni | D02G 3/385 | 57/10 |
| 6,718,748 | B1 * | 4/2004 | Patterson | D02G 3/385 | 57/13 |

* cited by examiner

*Primary Examiner* — Shaun R Hurley
(74) *Attorney, Agent, or Firm* — Stephen J. Stark; Miller & Martin

(57) ABSTRACT

A core cabling device and method provides a first supply of yarn supported by a structure having a bore, such as a yarn cone, and a second supply of yarn that is then directed through the bore. As the first and second yarns are fed simultaneously, the first yarn winds, at least loosely, about the second yarn. It will become apparent that more than two yarns may be cabled together in such a manner.

5 Claims, 2 Drawing Sheets

CORE CABLING

CLAIM OF PRIORITY

This application claims the benefit of U.S. Provisional Patent Application No. 61/791,241 filed Mar. 15, 2013 which is incorporated herein by reference in its entirety.

FIELD OF THE INVENTION

The present invention relates to core cabling techniques possibly for use for textile machinery such with creels, tufting machines, warping machines or the like, and particularly to a core cabling technique wherein a group of at least one of plurality of yarn strands such as received from a like number of yarn cones or other supplies are fed through at least one yarn guide tube (i.e., a cone) to which another yarn is then wound about as it dispenses from the cone for use with various technologies, in particular for some embodiments, textile machinery.

In textile machines, such as tufting machines, yarn is fed to the machine either directly from a creel or from a warper. A creel is a frame having an array of vertical and horizontal support members and including a multiplicity of yarn cone holders. A yarn cone is a spool about which yarn is wound. There are a multiplicity of yarn cone holders provided in horizontally and vertically disposed pairs, one cone holder of the pair mounting the active yarn cone and the other mounting a reserve or magazine cone used after the active cone is emptied. Conventionally, each cone holder pair has its own yarn guide tube through which yarn on each holder of the pair may be fed. A warper is a machine having a large spool, known in the art as a beam, on which yarn is wound and which subsequently supplies the yarn to a tufting machine.

In the art of tufting, generally a single strand of yarn is fed to each needle.

However, there are some occasions when it may be desirable to feed a plurality of fine yarn strands to each needle for providing tufted fabrics having unique patterns. Presently, when such need arises, in order to supply more than one yarn strand to a needle of a tufting machine, the yarn strands are cabled together onto a single yarn cone, or the reserve or magazine position is also used for mounting an active cone. Cabling involves winding the plural yarns onto a single yarn cone, but yarn manufacturers merchandise yarn cones with but a single yarn thereon. Thus, cabling requires unwinding the yarns from several cones and rewinding the yarns as a group onto multi-yarn cones. Cabling is therefore inconvenient and time consuming. Magazining, on the other hand, limits to two the number of yarn strands capable of being used and thus limits the pattern potential.

In U.S. Pat. No. 5,531,392, a group of yarn cone holders of a plurality of cone holders mounted in a vertical array have all of the guide tubes except the guide tube associated with the uppermost cone holder replaced by an eyelet. The yarn strand from a cone on a lowermost cone holder is directed through and by its associated eyelet to the next vertically adjacent or second eyelet and together with the yarn from the cone on the cone holder associated with the second eyelet is directed upwardly and through each subsequent eyelet and finally to and through the guide tube associated with the uppermost cone holder. All the yarns of the group including the yarn from the cone on the uppermost cone holder are guided by the guide tube to a header. Thus, all the yarns in a vertically disposed group can be fed together to a needle of a tufting machine or the like without cabling the yarns onto a yarn cone with the limitations thereof.

It may, however, sometimes be desirable to combine the yarns of a group of horizontally or laterally disposed yarn cones in a manner which also eliminates the need for vertical cabling such as is taught in U.S. Pat. No. 5,613,643. If, however, the yarns of a conventional creel are combined horizontally, there would be a mass of yarns in the location where the creel operator is positioned to service the creel, thereby preventing easy creel servicing. It should be realized that the creel operator must change yarn cones as the cones become exhausted of yarn and must also connect the leading end of the yarn on the reserve or magazine cone to the trailing end of the active cone. Thus, conventionally on at least the cone holder support post closest to the operator, the wire frame of the yarn cone holders face toward the operator.

Still further improvements are possible over these prior art designs.

SUMMARY OF THE INVENTION

Consequently, it is a primary object of many embodiments of the present invention to provide a yarn core cabling device wherein a plurality of yarn cones or other strand supplies may feed in series or parallel or linearly to and through a single yarn guide tube for cabling therearound and feeding a plurality of yarn strands for use by a machine such as a needle of a tufting machine or for winding onto the beam of a warping machine or the like.

It is another object of the present invention to provide a core cabling device wherein a group of yarn spool holders or other supplies direct yarn linearly along an axis of the spool holder or otherwise to and through at least one spool holder or cone in the group with its yarn being wound around the other(s) as they feed through the spool holder. Accordingly, the yarn on a spool mounted on the outermost holder of the group has yarn then fed through a bore in the spool or yarn cone to then be cabled enough by the strand on the outermost holder to be directed to a machine such as a textile machine utilizing the plural strands of yarn through a single needle directing yarn through a second yarn cone.

Accordingly, the present invention provides a core cabling device for feeding strands, such as yarn to a textile machine such as a tufting machine or a warper, the core cabling device for at least one embodiment comprising a framework of interconnected support members, a plurality of spaced yarn cone mounting members fixed to spaced apart support members for mounting respective yarn cones. Certain of the spaced mounting members form a group. A first of the yarn cones (or other yarn or stand holder) of the group directs its yarn or strand to and through a subsequent yarn or stand cone(s) of the group and onward, possibly finally to a yarn tube, and from the tube to the header leading to the textile machine. With this an arrangement, it is not necessary to cable yarns onto yarn cones as aforesaid. More than two yarns or strands may be fed to a yarn using instrumentality, such as a needle, of a textile machine, such as a tufting machine. The use of eyelets as has been done with the inventor's prior patents can be eliminated.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
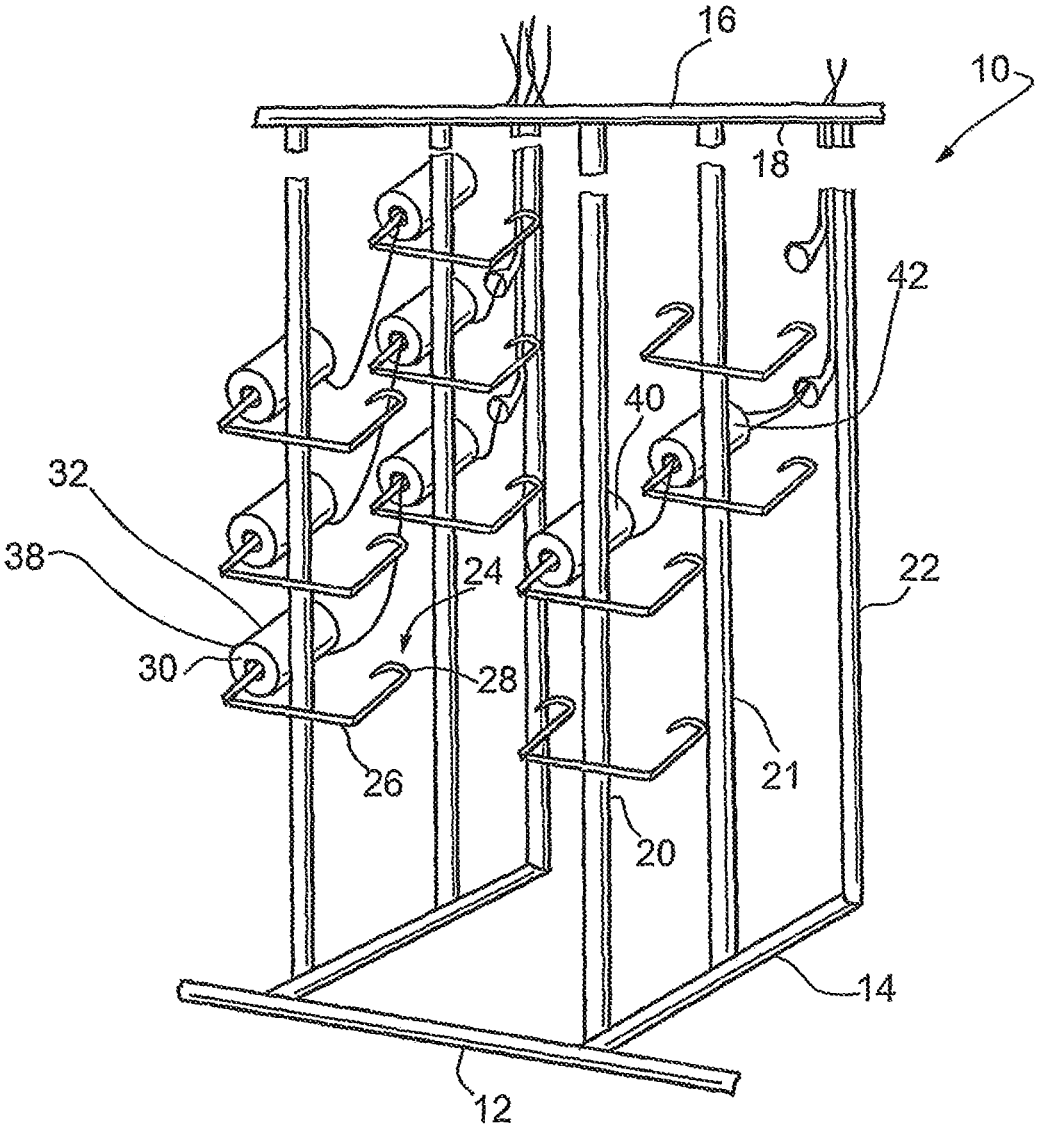
FIG. 1 is a fragmentary exploded perspective view of a creel constructed in accordance with the present invention.

One core cabling device 10 constructed as a creel in accordance with a preferred embodiment of the present invention includes a plurality of horizontally disposed side and end support members 12, 14 forming a base of the creel, the members 14 extending substantially 90 degrees to the members 12. Spaced above, and substantially parallel to each of the horizontal support members 12, 14 is a plurality of similarly disposed side and end members 16, 18 which may form the top of the creel. Secured to and extending vertically between the side members 12, 16 are a plurality of vertical support members 20. The device 10 as a creel thus comprises a framework in an array of vertical and horizontal support members, it being understood that the framework includes a substantial number of similar such supports and that for purposes of presentation only a small number are illustrated in FIG. 1. The length of the sides and ends of a creel of this type, for example, may be approximately 15 to 25 feet long and extend 12 to 15 feet in height. Secured at various locations between each pair of horizontal support members 14, 18 is a vertical post or frame member 22 corresponding to a vertical support member 20. Each creel post preferably comprises cylindrical pipe whereas the frame members 12, 14, 16, 18 preferably comprise angle irons. While a creel is illustrated, the technology is applicable to many other structures, as will be explained in further detail below.

Conventionally, as disclosed in the aforesaid patents, each creel post 22 normally includes a plurality of pairs of vertically spaced apart cone holders. However, in accordance with the present invention the cone holders 24 are mounted on the support members 20, 21. More support members 20, 21 could be provided for providing additional yarn strands in a group. Each cone holder may be formed from metal rod 26 bent into a U-shape form having a central portion and a pair of outstanding legs. The central portion of each cone holder is welded to the support member 20, and each of the legs may be constructed from a wire form 28 on which a yarn cone 30, about which yarn 32 is wound, may be frictionally held. The wire form 28 faces toward a corresponding vertical frame member 22 and receives the yarn cone. The yarn end may feed from the cones away from the operator. A cone thus may be mounted on each wire form, one of the cones actively supplying yarn, while the other may be a magazine or reserve cone. Each creel support member 20, 21 may contain a stack of yarn cone holders 24 as illustrated.

Except for the nature of yarn feed through yarn cones and a corresponding grouping of yarn strands to a guide, a creel constructed as thus described is conventional and well known in the art. In the prior art there is an elongated plastic yarn guide tube such as tube 34 corresponding to each yarn core holder 24 having an inlet end facing the respective cone holders and an outlet end opening in a header at the top of the creel at the end facing the textile machine served by the creel. A strand of yarn from each cone is directed into the corresponding guide tube and guided to the header where it exits and is directed to the textile machine.

In accordance with a preferred embodiment of the invention, the yarn strands from a group of yarn cones are fed to the inlet of a single guide tube 34 with yarn from preceding yarn cone directed through the center of the next yarn cone, etc. While this can be done with creels as a device, it also can occur with other yarn strands, such as those fed from beams, spools or other dispensers, but the strands or strands then proceed through a cone holder bore about which the next yarn is disposed (wound) and is directed off. The guide tube associated with the yarn cones of a group receive the loosely joined yarns for all of the group of yarns to be fed through a single needle for the preferred embodiment.

Figure 2:
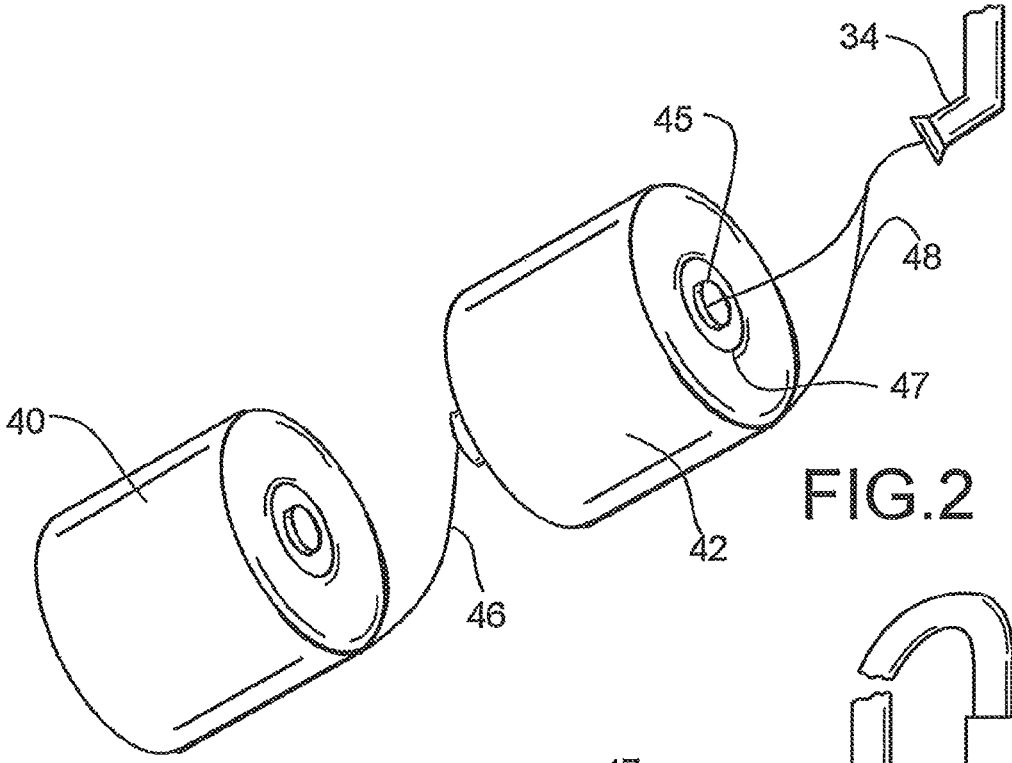
FIG. 2 is a fragmentary perspective view illustrating the manner in which yarn strands from a group of two yarn cones are guided.
Figure 3:
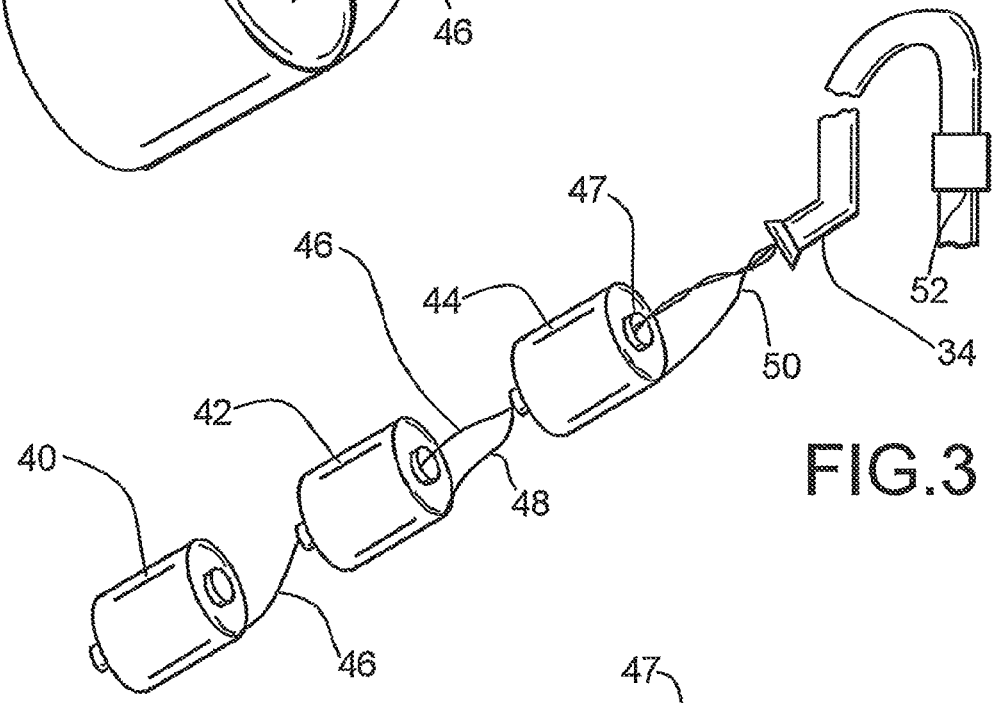
FIG. 3 is fragmentary perspective view illustrating the manner in yarn strands from a group of three yarn cones are guided.
Figure 4:
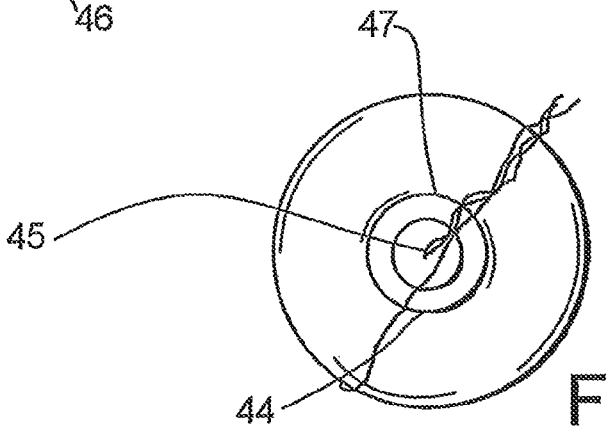
FIG. 4 is an elevation view of the apparatus illustrated in FIGS. 2 and 3 along the feed axis.

Thus, as best illustrated in FIGS. 2 and 3, two or three such cones can be mounted on spaced apart respective cone holders, may form a group in which the cones are disposed vertically, linearly or otherwise, such as one forward the other, etc. The yarn strand 46 from cone 40, which may be the vertically lowest and/or first cone of the group relative to the cone 44 with which the guide tube 34 (and group) is associated, is threaded into and through the cone 42 in front (and/or above or even below it) and is then directed toward and through the cone 44 and then toward and into the guide tube 34, or to such as through its center or spool one or more eyelets or cones if the group consists of one or more additional yarn cones. No eyelets are required for many embodiments, for the presently preferred embodiment which differentiates the prior art.

A cone holder such as cone 44 has a hollow bore 45 and a structure 47 thereabout about which strand such as yarn strand 50 is wound. Structure 47 could be cone shaped, cylindrical shaped, or other appropriate shape so long as a strand such as strand 48 (regardless of what it is fed from) can feed through the bore 45 which must be internal to the strand 50 when on the structure 47. As long as the strand 50 is wrapped about the structure 47 and unwinds as it comes off the structure with an internally directed strand such as 46 and/or 48 and/or others, then such technology could apply whether it be related to yarns and tufting or even other technologies. However, even if such technology does exist outside of the tufting area, there is not believed to be any teaching or suggestion to use such technology with the feeding of yarn and/or tufting machines.

Referring back to the preferred embodiment, thus, both yarn strands 46 and 48 can be threaded into and through the cone 44 and directed on to and through guide tube 34. The yarn strands 46 and 48 together with the yarn strand 50 from the outermost cone 40 are thereafter directed into the inlet of the guide tube 34 and on towards an industrial use. The strand 50 is thus an outer strand about 46 and 48 (strand 48 is about strand 46, but other embodiments may feed strands 46 and 48 in parallel or otherwise into cone 44 for strand 50 to then relatively loosely, for at least some embodiments, be wrapped therearound). If it is desired to supply more than three yarn strands as a group to a needle of a tufting machine or the yarn using instrumentality of another textile machine, there could be other yarn cones, beams, spools, etc., disposed intermediate the cones 40 and 44. The number of such cones or other structure feeding strands being dependent upon the number of additional yarn strands desired in the group. Each such additional yarn strand could be fed to a corresponding additional cones which would also receive the yarn strands 46 and 48 and all of such yarn strands would together with the yarn strand 50 be directed into the tube 34.

Each tube 34, if provided, extends into a header 52 at the top of the end of the device 10 if the device is a creel, such as a creel most adjacent to the textile or other machine served, i.e., at the left end of the creel illustrated in the drawings. The yarn strands from each guide tube at the header may then be withdrawn and sent to the textile machine. Other stand types may be fed to winders, warpers, or other machinery or take up devices. For example, the yarn strands from each tube may be guided and threaded into the eye of a needle so that the needle will tuft or sew with the plurality of yarn strands 46, 48, and/or 50. It should be understood that since each yarn cone 40, 42, 44 is mounted on a respective yarn cone holder 24, the plurality of yarn cone holders corresponding to the yarn cones 40, 42, 44, etc. form a group of vertically disposed holders, each of which has a corresponding eyelet guide tube 34.

With the construction of the present invention there is but a single guide tube for each group of yarns. Since a tufting machine, for example, may have 1000 to 1500 needles, the number of guide tubes would total that amount. On the other hand, if there was a guide tube corresponding to and carrying but a single yarn strand, a group of three yarns to be fed to a single needle would require 3000 to 4500 tubes and the yarns exiting the header would cause confusion for those threading the machine.

While yarn strands and creels are discussed above, they are effective for that use, Still there are other uses for a core cabling device 10 apart from creels for use with various yarn strands such as strands 46,48,50. There are certainly other strand types other than yarn that could use similar technologies and other devices other than creels to which this technology would apply including warpers, beam related strand feeding devices, and still others.

Numerous alterations of the structure herein disclosed will suggest themselves to those skilled in the art. For example, two yarn strands may be fed, one of which is associated with an eyelet and the other with a guide tube. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of core cabling yarns comprising:

a) providing a first yarn supply having at least a first yarn wound around a structure having a bore therethrough and a second yarn supply directing at least a second yarn through the bore of the first yarn supply independently of eyelets until contacting the first yarn;

b) and then at least loosely winding the first yarn around the second yarn as the first and second yarns are fed simultaneously together as the first yarn is fed from the first yarn supply.

2. The method of claim 1 further comprising the step of providing a third yarn directed thorough the bore of the first yarn supply; and wherein the step of simultaneously feeding the first and second yarns further comprises simultaneously feeding the first, second and third yarns together downstream of the first yarn supply.

3. The method of claim 2 further comprising the step of providing the third yarn from a third yarn supply and the second yarn supply being supported by a structure having a bore, and further comprising the step of feeding the third yarn through the bore of the structure supporting the second yarn supply.

4. The method of claim 3 wherein the step of feeding the first second and third yarns further comprises the first yarn winding around the second and third yarns as the first, second and third yarns are fed simultaneously.

5. The method of claim 1 further comprising the step of providing a creel supporting the first and second yarn supplies and a guide tube, wherein the first and second yarns are fed through the guide tube away from the first yarn supply.

* * * * *